US010028575B1

(12) United States Patent
Schaffler

(10) Patent No.: US 10,028,575 B1
(45) Date of Patent: Jul. 24, 2018

(54) FRICTION-DRIVEN ROTARY PUSH BROOM

(71) Applicant: Samuel Aubin Schaffler, Tulsa, OK (US)

(72) Inventor: Samuel Aubin Schaffler, Tulsa, OK (US)

( * ) Notice: Subject to any disclaimer, the term of this patent is extended or adjusted under 35 U.S.C. 154(b) by 811 days.

(21) Appl. No.: 14/469,320

(22) Filed: Aug. 26, 2014

Related U.S. Application Data

(60) Provisional application No. 61/870,319, filed on Aug. 27, 2013.

(51) Int. Cl.
*A46B 13/08* (2006.01)

(52) U.S. Cl.
CPC ..... *A46B 13/08* (2013.01)

(58) Field of Classification Search
CPC ..... A46B 13/08
See application file for complete search history.

(56) References Cited

U.S. PATENT DOCUMENTS 4,094,032 A * 6/1978 Liebscher ..... A47L 11/33 15/179
4,864,674 A 9/1989 Hamilton
6,321,405 B1 * 11/2001 Whittaker ..... A46B 13/001 15/41.1
8,065,771 B2 * 11/2011 Hui ..... A46B 3/22 15/1.7
8,156,596 B2 4/2012 Rose

* cited by examiner

*Primary Examiner* — Randall Chin
(74) *Attorney, Agent, or Firm* — Gable Gotwals

(57) ABSTRACT

A rotary push broom provides a geometry between the centerline of the broom's wheels and the centerline of the broom's cylindrical brush that allows the vertical height of the cylindrical brush relative to that of the wheels to be adjusted as the frame rotates. The broom includes a support stand that allows the broom to be stored in a way that does not put the broom's weight on the brush. The broom also includes a ratchet gear system so that the broom rotates along with the wheels when the broom is operated in a forward sweeping direction and spins independent of the wheels when the broom is operated in a rearward direction. The gear system should be arranged so that the cylindrical brush rotates slower than the wheels in the sweeping direction. The support stand can be integrated with an endplate that accommodates the wheel connection and ratchet gear system.

21 Claims, 5 Drawing Sheets

FRICTION-DRIVEN ROTARY PUSH BROOM

CROSS-REFERENCE TO CO-PENDING APPLICATIONS

This application claims priority to U.S. Provisional Patent Application No. 61/870,319 for Friction Driven Rotary Push Broom filed on Aug. 27, 2013.

BACKGROUND OF THE INVENTION

The primary function of a push broom is to sweep large areas. One of the problems with existing push broom designs is that debris is left behind after the broom makes a single pass in the forward sweeping direction. To sweep up the left-behind debris, a user must make multiple passes with the broom, lifting the broom in a circular type motion, pulling it back toward the user, and re-sweeping much if not all of the same area as was originally swept.

Over the years, alternative sweeping devices have been developed to allow users to sweep large areas more efficiently. Many of the alternative sweeping devices require external power or incorporate bins for capturing debris, neither of which is desirable in a lot of cases.

One example of a manually operated rotary broom is disclosed in U.S. Pat. No. 4,864,674 to Hamilton. The broom includes a removable disc with blades and a locking arrangement that, depending in part on the angle of the handle, locks and unlocks to provide a standard push broom mode and a continuous rotation pick-up (dustpan) mode. The dustpan mode deposits debris in a cylinder housed between the wheels. The disc and wheels share a common centerline.

Another example of a manually operated rotary broom is disclosed in U.S. Pat. No. 8,156,596 B2 to Rose. The broom includes a pre-adjusted cylindrical brush height as well as gearing that permits the cylindrical brush to rotate at a faster rotational speed than, and in a opposite direction to, the wheels but not disengage from the wheels. When the broom is operated in the forward sweeping direction the cylindrical brush sweeps debris ahead of itself, away from the user. However, faster rotational speed can cause debris to be thrown too far ahead of the broom and fine debris to rotate back around the brush and be left behind by the broom. When the broom is pulled back toward the user, the brush continues to rotate and now sweeps some of the debris back toward the user. In the cylindrical brush's highest position, the centerline of the wheels and that of the brush are in the same horizontal plane with the brush centerline leading the wheels. In the brush's lowest position, the centerline of the brush is below that of the wheels.

SUMMARY OF THE INVENTION

A rotary push broom made according to this invention provides a geometry, rotational speed and storage means that make it very different from other manually operated rotary brooms. The geometry allows the vertical height of the cylindrical brush relative to that of the wheels (and therefore the surface to be swept) to be adjusted simply by rotating the frame with the handle while the broom is in use. An alternate embodiment keeps the handle in the same position but relies on a hinged connection to the broom's frame to rotate the frame.

The storage means, preferably in the form of an end plate that serves as support stand or "kickstand," allows the broom to be stored in a way that does not put the broom's weight on the brush. This eliminates the creation of a flat spot which leads to uneven rotation and reduced sweeping performance, as well as premature replacement of the brush. The support stand could also be separate from the end plate and put elsewhere on the frame to serve the same kickstand function. The stand could also be in the form of a rod which extends from the middle of the frame.

In one embodiment of the rotary push broom, the broom includes a pair of wheels arranged in a frame along a same centerline and a cylindrical brush arranged in the frame along a centerline different than the centerline of the pair of wheels. The centerline of the cylindrical brush is arranged such that an angular rotation of the frame of the rotary push broom changes a vertical height of the cylindrical brush relative to the centerline of the wheels. For example, the centerline of the cylindrical brush can be rearward of the wheels and in the same horizontal plane as the wheel centerline.

A ratchet gearing system is arranged to reduce a rotational speed of the cylindrical brush relative to that of the pair of wheels when the pair of wheels is rotating in a forward (sweeping) direction away from a user but allows the cylindrical brush to rotate independent of the pair of wheels when the pair of wheels is rotating in a rearward direction.

The ratchet gearing system can include a first gear connected to a wheel in the pair of wheels and a second gear mated to the first gear and connected to a drive shaft of the cylindrical brush. Preferably, both wheels have this first and second gear combination. The second gear preferably has at least one cavity which receives the drive shaft and has a curved surface and an opposing flat surface. In this arrangement, the drive shaft has a key arranged to engage the opposing flat surface when the pair of wheels is rotating in the forward direction and engage the curved surface when the pair of wheels is rotating in the rearward direction.

The end plate can be arranged between one of the wheels and an opposing end of the cylindrical brush. When intended for use as a kickstand, the end plate should have a flat bottom end and extends forward of the wheels to maintain the rotary push broom in a free standing state when not in use (e.g., the handle of the broom in a 12 o'clock position).

The end plate when configured as a kickstand should be arranged so that when the frame is titled in a rearward direction the bottom end of the plate does not extend past—and is preferably at a vertical height above—the lower surface brush in contact with the surface being swept (i.e. above ground level and not even with the wheels). When in the free-standing state the bristles of the brush lying opposite the floor surface should be at a vertical height above that of the bottom end of the endplate so that no weight is placed on the bristles.

The end plate with or without the integrated support stand can include two openings, with one opening co-axial to the centerline of the pair of wheels and the other opening co-axial to the centerline of the cylindrical brush, to accommodate the wheel connection and the ratchet gearing system.

In another preferred embodiment of the rotary push broom, the broom includes a pair of wheels arranged in a frame along a same centerline and a cylindrical brush arranged in the frame along a centerline different than and rearward of the centerline of the pair of wheels. A ratchet gearing system is arranged to rotate the cylindrical brush when the pair of wheels is rotating in a forward direction and cause the cylindrical brush to rotate independent of the pair of wheels when the pair of wheels is rotating in a rearward direction. At least one support stand, which could be in the form of an endplate, is arranged between one of the wheels in the pair of wheels and an opposing respective end of the cylindrical brush. Again, the stand can be separate from the end plate and placed elsewhere on the frame. The ratchet gearing system can be arranged such that a rotational speed of the cylindrical brush is slower than that of the wheels in the forward direction. The centerline of the cylindrical brush should be arranged such that an angular rotation of the frame changes a vertical height of the cylindrical brush relative to the centerline of the wheels.

The at least one end plate, and preferably both, can be arranged to connect one of the wheels to the frame and accommodate at least a portion of the ratchet gearing system. A crossbar can connect the kickstand to the frame.

Objectives of this invention include providing a manually operated rotary push broom that (1) rotates at a slower rotation than that of the wheels when the broom is moving in a forward direction; (2) has a free-spinning state independent of the wheels when the broom is moving in a rearward direction; (3) can adjust the height of the cylindrical brush as the broom is being used; and (4) maintains the broom in a free-standing state and in such a way that no weight is placed on the bristles of the cylindrical brush.

ELEMENTS AND NUMBERING USED IN THE DRAWINGS

Figure 1:
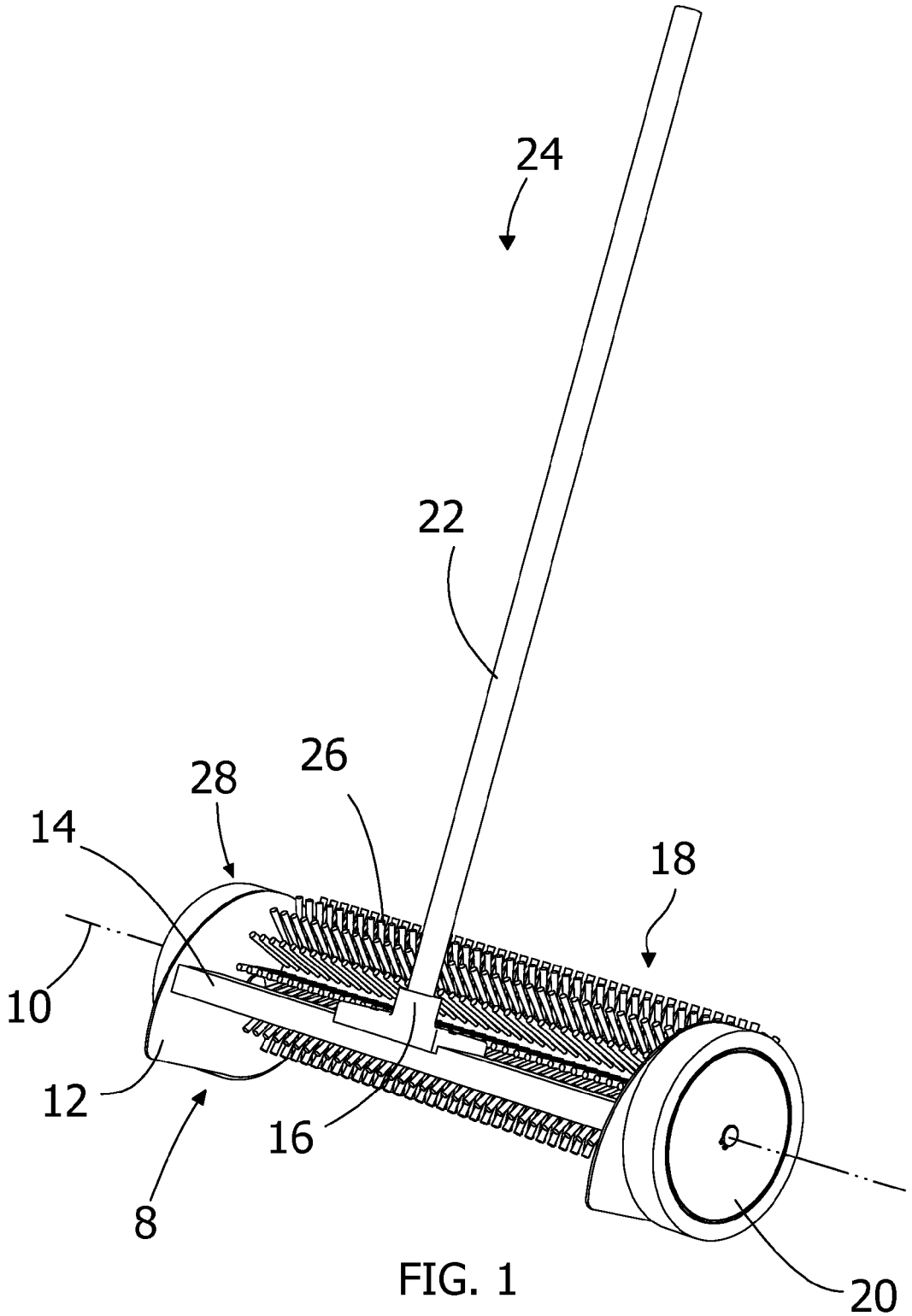
FIG. 1 is a preferred embodiment of a rotary push broom made according to this invention. The broom includes a kickstand which allows the broom to be stored without placing any weight on the bristles of the cylindrical brush and can vary the height of the cylindrical brush when in use. Ratchet-style gearing allows the cylindrical brush to disengage from the wheels when the broom is pulled in a direction opposite that of the forward sweeping direction.

8 Frame
10 Centerline/axis of rotation of wheel 20
12 End plate with integrated support stand
14 Crossbar
16 Handle connector
18 Cylindrical brush
20 Wheel
22 Handle
24 Rotary push broom
26 Brush bristle
28 Ratchet gear system
30 Lock ring
32 Brush or second gear
34 Drive key
36 Gear/drive shaft
38 Bushing or bearing
40 Wheel axle
42 Direction of wheel rotation when broom is in sweeping (forward) direction
44 Direction of brush gear rotation (and therefore brush 18) when broom is in sweeping direction
46 Wheel or first gear 46
48 Dust guard
50 Centerline/axis of rotation of cylindrical brush 18
52 Cavity located on inside of 36
54 Curved side of 52
56 Flat side of 52 opposite 54
58 Flat bottom side of 12
60 Arcuate-shaped top side of 12
62 Forward end of 12
64 Rearward end of 12
66 First opening
68 Second opening

DETAILED DESCRIPTION OF THE PREFERRED EMBODIMENTS

Referring to the drawings, a preferred embodiment of a rotary push broom 24 made according to this invention includes a ratchet gear system 28 that provides rotational force to the cylindrical brush 18 in the push direction but disengages the brush 18 in the opposite direction and an end plate 12 that serves as support plate or kickstand that permits the broom 24 to be stowed in a free-standing, upright position such that none of the brush bristles 26 contact the ground when stowed.

Broom 24 preferably does not make use of a wheel axle that runs wheel-to-wheel or through the brush, nor does it make use of an external frame structure. Instead, a crossbar 14 connects opposing end plates 12 to one another to form a frame 8. A handle connector 16 on crossbar 14 connects handle 22 to the crossbar 14. Each end plate 12 is preferably arranged so that when the handle 22 is in the 12 o'clock (upright) position, the end plates 12 maintain the broom 24 in the upright position. A forward end 62 of the end plate 12 preferably extends past the wheels 20 so that greater stability is provided to the broom 24 when being stowed.

One end plate with integrated support stand 12 may be used but two are preferred. Alternatively, the support stand itself could be separate from the end plate 12 and connected elsewhere to the frame (e.g., in the middle of the frame as a rod or its equivalent extending forward of the frame). If only one end plate with integrated support stand 12 is used, the other end plate 12 must be replaced by an equivalent structure for performing the other functions of the plate 12, such as connecting itself to crossbar 14 to create a frame 8 and providing means to connect the wheel 20 and accommodate the ratchet gear system 28 for the cylindrical brush 18.

Each end plate 12, for purpose of serving as the support stand, is preferably tear drop-shaped having a flat bottom side 58, an arcuate-shaped top side 60, and a semi-circular shaped rearward end 64. The end plate 12 includes two openings 66, 68 which accommodate wheel connections and the ratchet gear system 28. The first opening 66 is arranged coaxial with the centerline 10 of wheel 20. At least one of the end plates 12 is arranged to accommodate the ratchet gear system 28.

Figure 2:
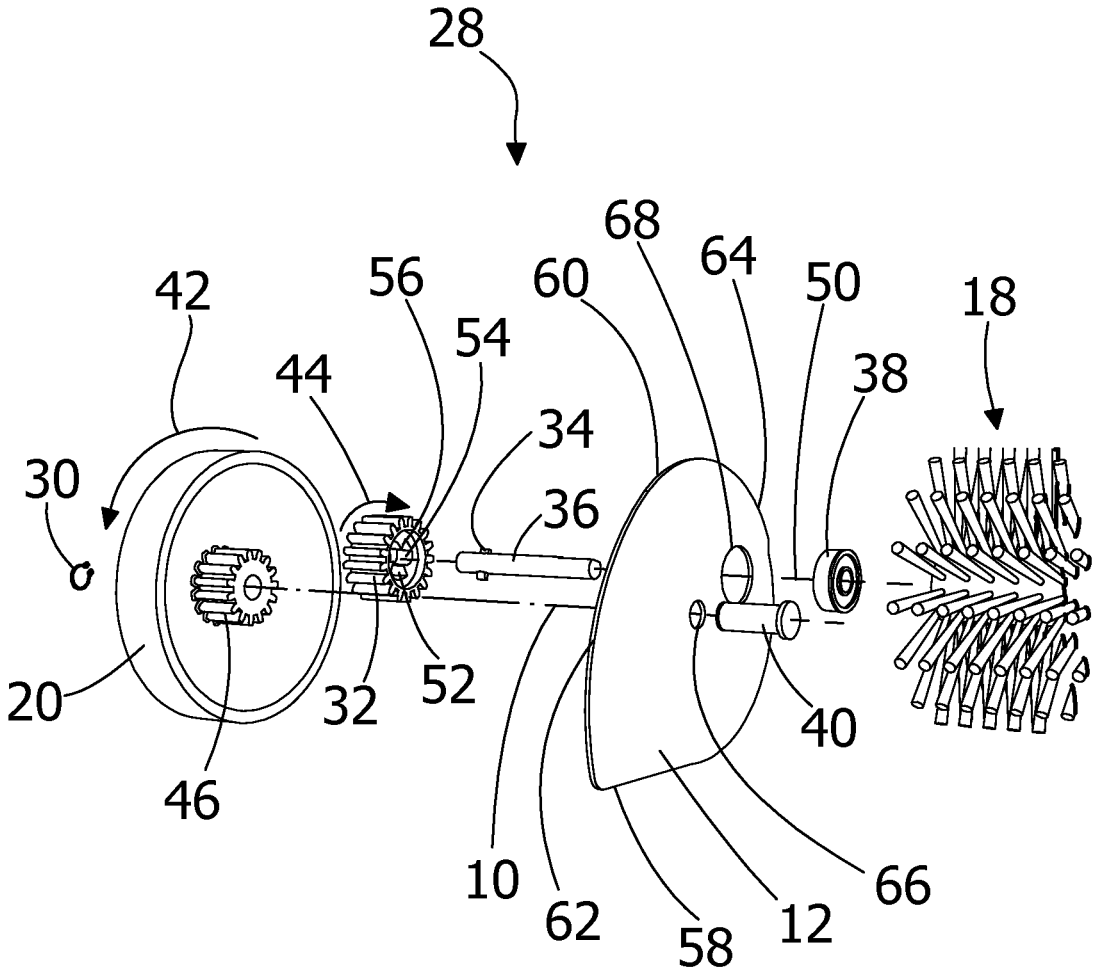
FIG. 2 is an exploded assembly view of a preferred embodiment of the ratchet-style gearing used in the rotary push broom of FIG. 1.

Each wheel 20 can be connected to its respective end plate 12 by a wheel axle 40 that passes through the opening 66 and the wheel 20 and receives a locking ring 30 (see FIG. 2). Wheel axle 40 preferably does not extend wheel-to-wheel or through the brush 18 so that, as described below, the brush centerline 50 can be placed in various relationships to the wheel centerline 10.

During operation, the wheels 20 contact the surface to be swept and rotate due to friction. Preferably, wheels 20 are located outside of cylindrical brush 18 but may also be located within the interior of the brush 18 so that portions of the brush 18 lie outside of the wheels 20. When handle 24 is moved in a rearward (user) direction, at least a portion of the bottom side 58, and preferably all of the bottom side 58, of the end plate 12 raises up so that the bottom side 58 is above that of the lower or contacting surface of the wheels 20. For example, in one preferred embodiment, when the cylindrical brush 18 is engaged with the floor surface, the bottom side 58 of the plate 12 is about 3" above the floor surface with the rearward end 64 about ⅛" above the floor surface. This height changes as the frame 8 rotates to different angular orientations.

The second opening 68 is offset from the first opening 62 so that it is coaxial with the centerline 50 of the cylindrical brush 18. A bushing or bearing 38 resides within the opening 68 and receives a drive shaft 36 for the cylindrical brush 18. When rotary broom 24 is operated in the forward, sweeping direction, the leading end of brush bristles 26 trail behind the leading surface of the wheels 20. Alternatively, the brush 18 could be sized or arranged such that the bristles 26 lie ahead of the leading surface of the wheels 20.

The centerline 50 of the cylindrical brush 18 is offset from and behind the centerline 10 of the wheels 20. Preferably, the two centerlines 10, 50 lie in the same horizontal plane. The two centerlines 10, 50 could be in other relationships to one another so long as each is separated by a distance which accommodates the ratchet gear system 28 and provides the desired rotational relationship between the wheels 20 and the cylindrical brush 18. For example, the brush centerline 50 could be directly above the wheel centerline 10 and approach the floor surface as the frame 8 rotates downward toward the surface.

Figure 3:
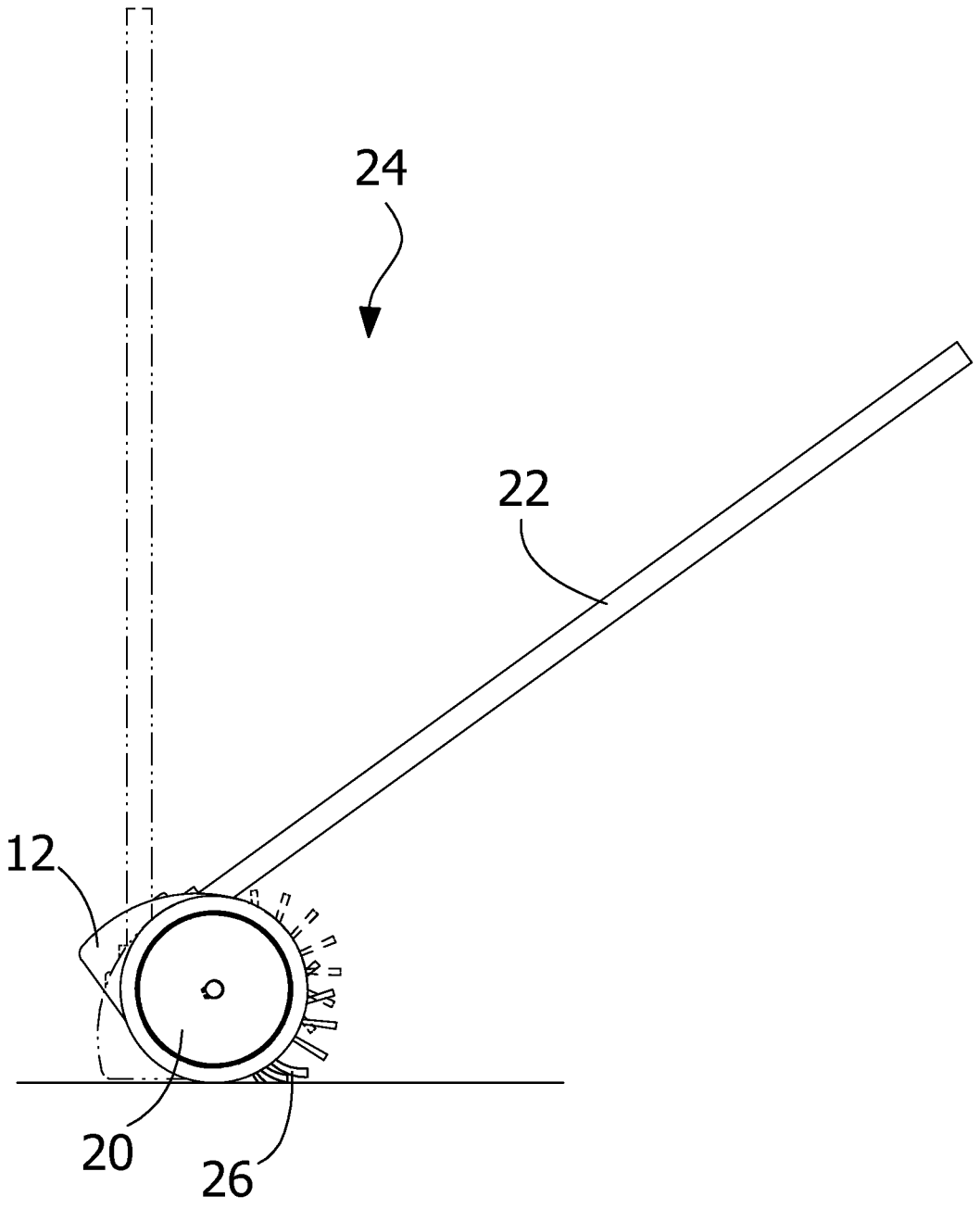
FIG. 3 is a view of the rotary push broom of FIG. 1 as it moves between a stowed, upright position and an in-use position. As the broom moves between the two positions, the height of the cylindrical brush relative to the wheels (and therefore ground level) changes.
Figure 4:
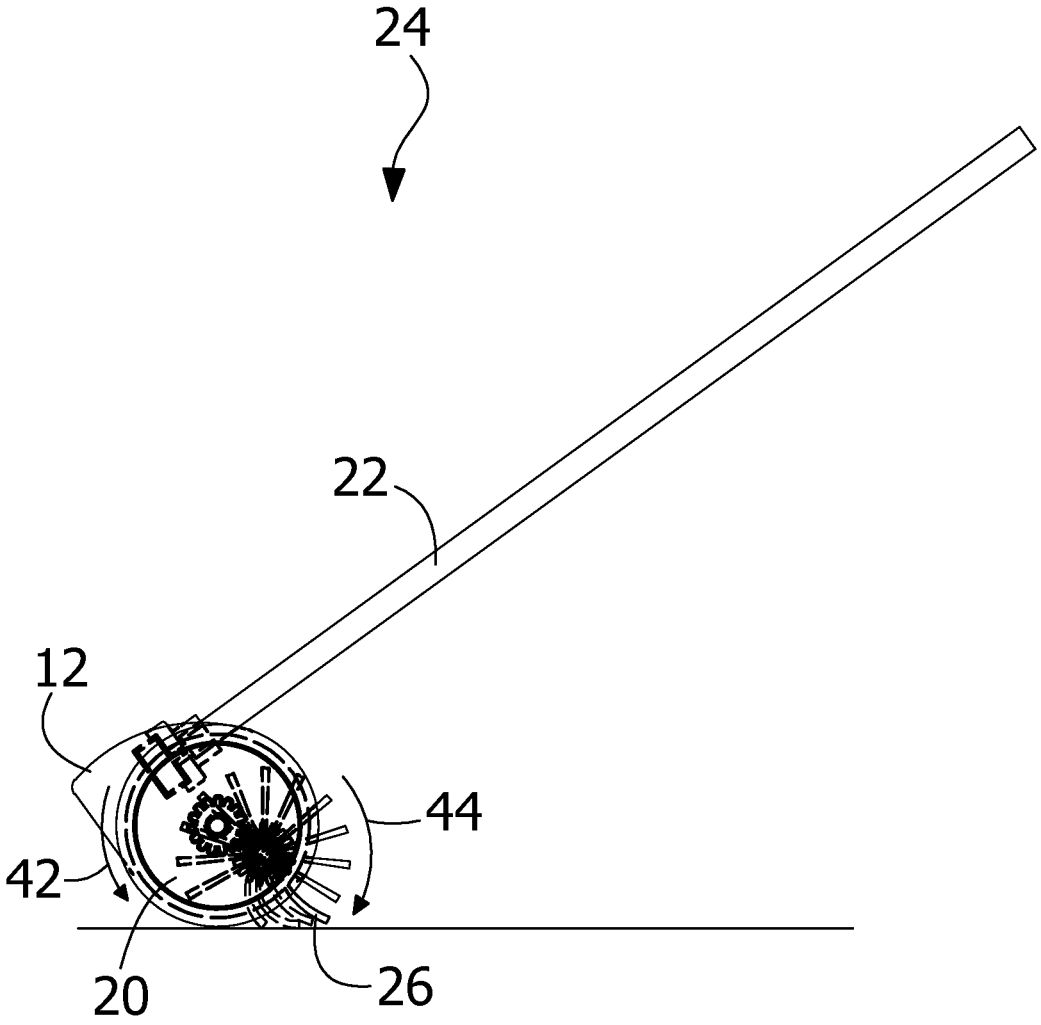
FIG. 4 is the rotary push broom of FIG. 1 as it operates in the forward (sweeping) direction.
Figure 5:
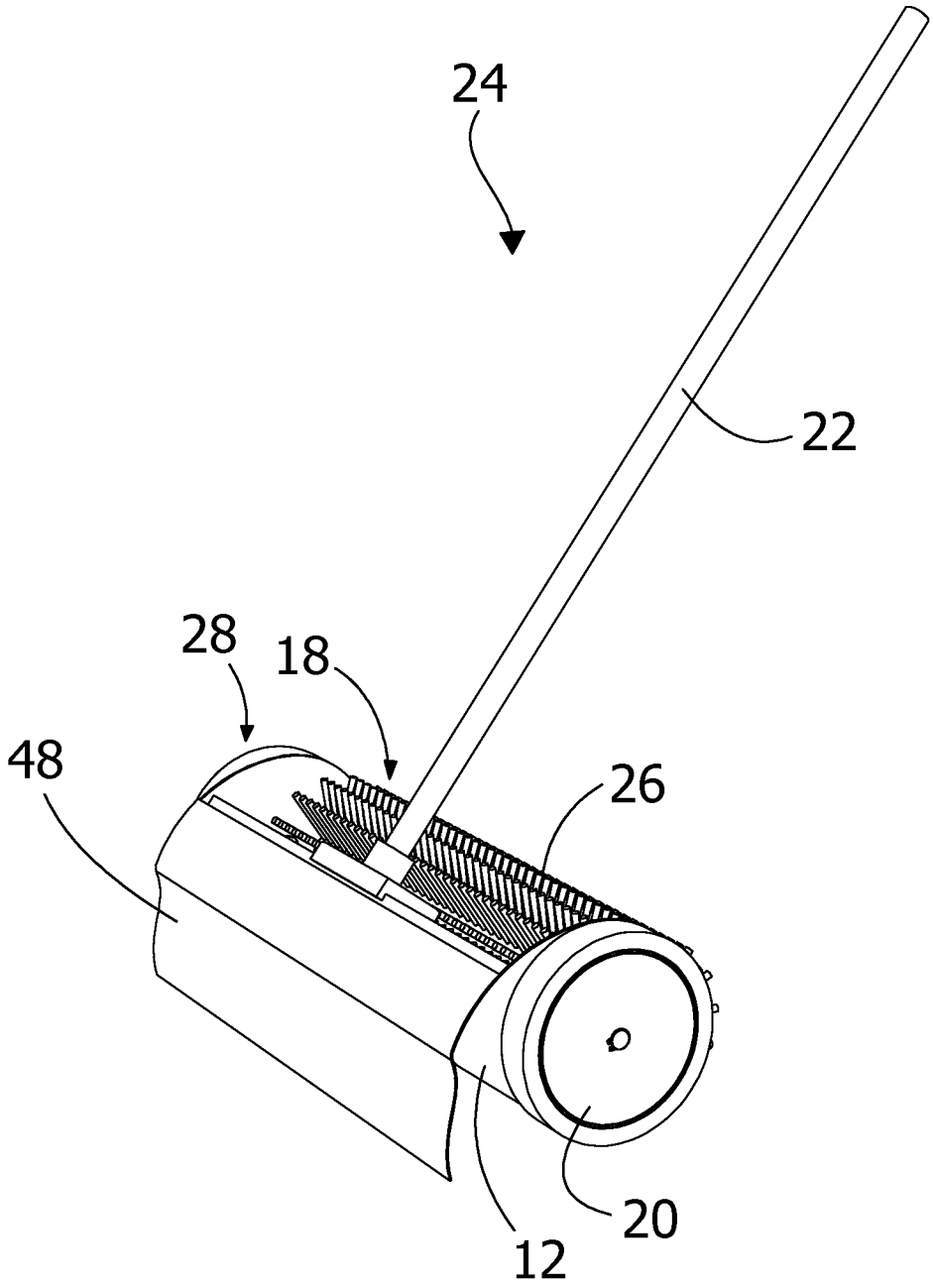
FIG. 5 is an alternate embodiment of the rotary push broom having an optional dust guard attached to a forward end of the frame.

Because the centerline 50 of the cylindrical brush 18 is different than the centerline 10 of the wheels 20, and is rearward of the centerline 10, as the handle 22 moves to different angular positions during use, the brush bristles 26 vary in their relationship to the surface being swept. In other words, the vertical height of the cylindrical brush 18 relative to that of the wheels 20 changes. For example, the centerline 50 can be arranged such that a certain angular orientation of handle 22 (e.g., 45° from horizontal) rotates the frame 8 and places the centerline 50 at a distance from the surface to be swept which equals that of the length of the bristles 26, with smaller angles from horizontal causing an interference condition between the surface and bristles 26 (see e.g. FIG. 3) and larger angles providing no contact with the surface whatsoever.

Each wheel 20 includes a wheel or first gear 46 that mates to a brush or second gear 32. The preferred gearing relationship is such that the cylindrical brush 18 rotates at a slower speed than do the wheels 20. This is opposite the trend in manual rotary brush design, which equates faster brush rotation with more effective sweeping and cleaning action. A series of experiments conducted by the inventor showed that slowing the speed of the brush made an unexpected and surprising difference in containing debris ahead of the brush, reducing the amount of dust, and overall cleaning effectiveness (and therefore efficiency) of the broom 24.

Experiments conducted by the inventor show that a slower-than-wheel brush turn provides better sweeping performance than a faster-than-wheel brush turn (see Table 1 below). Preferably, the cylindrical brush 18 rotates slower than the wheels 20 and, more preferably, at no greater than 75% the rotational speed of the wheels 20. At this speed, the broom 24 left only 10% of the debris left behind by a push broom after a single pass under the same test conditions. Also, preferably the brush 18 rotates no slower than 35% of the rotational speed of the wheels 20. This ratio can be manipulated by changing wheel diameter and brush diameter and the gearing 32, 46 to determine the best speed for the surface to be swept and type of debris being swept. The rotation of the brush 18 can be in a range of 30 to 90% of that of the wheels 20.

TABLE 1

Experimental Results.*

| Broom | Method & Wheel:Brush Gear Ratio (if applicable) | Debris Level % Relative to Normal Push Broom Single Pass (Baseline) |
|---|---|---|
| Normal | Single pass | Baseline |
| push broom | Two passes | 45 |
| Rotary | 2.9:1 | 75 |
| push broom | 1.5:1 | 65 |
| | 0.76:1 | 10 |
| | 0.33:1 | 65 |

*Visual inspection of area after pass with broom. All rotary push broom runs consisted of a single pass.

Brush gear 32 provides ratchet-type performance to the cylindrical brush 18. The gear 32 preferably includes three identical and equally spaced-apart cavities 52 on the inside of the gear 32. Each cavity 52 is curved on one side 54 and flat on the other side 56. As gear 32 rotates in the free-spinning direction (opposite that of direction 44, meaning the wheels 20 are rotating opposite that of direction 42), a drive key 34 on drive shaft 36 is engaged by the curved side 54 of each cavity 56, which pushes the drive key 34 back-and-forth through a slot in drive shaft 36. The rotary brush 18, therefore, rotates independent of the wheels 20 when the wheels are rotating opposite the forward direction 42.

As gear 32 rotates in the "drive" or forward (push or sweep) direction 44—meaning the wheels 20 are rotating in their forward direction 42, the drive key 34 is engaged by the flat portion 56 of the cavity 52 and force transmitted to the key 34 rotates the drive shaft 36. The rotary brush 18 rotates dependent on the wheels 20, with the brush 18 rotation 44 being opposite that of the wheels 20 and slower than that of the wheels 20.

Other designs may be used for ratchet gear system 28 provided those other designs provide rotation of the brush 18 in the forward direction and free spinning in the opposite direction.

A foldable guard 48 may be added to the broom 24 to stop or knock down debris as it moves away and ahead of the brush 18. Guard 48 may be made from canvas or other wear resistant material. Alternatively, the broom 24 can be free of any capturing device or receptacle.

While preferred embodiments have been described, not all possible embodiments of the invention have been. The following claims define the scope of the invention and include the full range of equivalency to which the specific requirements of the claims are entitled.

What is claimed:

1. A rotary push broom comprising:

a pair of wheels arranged in a frame along a same centerline;

a cylindrical brush arranged in the frame along a centerline different than the centerline of the pair of wheels; and a ratchet gearing system arranged to provide a different rotational speed of the cylindrical brush relative to that of the pair of wheels when the pair of wheels is rotating in a forward direction and cause the cylindrical brush to rotate independent of the pair of wheels when the pair of wheels is rotating in a rearward direction;

wherein the centerline of the cylindrical brush is arranged such that an angular rotation of the frame of the rotary push broom changes a vertical height of the cylindrical brush relative to the centerline of the wheels.

2. A rotary push broom according to claim 1 wherein the centerline of the cylindrical brush is rearward of the centerline of the pair of wheels.

3. A rotary push broom according to claim 1 further comprising the ratchet gearing system including a first gear connected to a wheel in the pair of wheels and a second gear mated to the first gear and connected to a drive shaft of the cylindrical brush.

4. A rotary push broom according to claim 3 further comprising the second gear having at least one cavity which receives the drive shaft, the at least one cavity having a curved surface and an opposing flat surface.

5. A rotary push broom according to claim 4 further comprising the drive shaft having a key, the key arranged to engage the opposing flat surface when the pair of wheels is rotating in the forward direction and engage the curved surface when the pair of wheels is rotating in the rearward direction.

6. A rotary push broom according to claim 1 further comprising the frame having at least one support stand, the at least one support stand arranged to maintain the rotary push broom in a free standing state when not in use.

7. A rotary push broom according to claim 6 wherein the free standing state places a handle of the broom in a 12 o'clock position.

8. A rotary push broom according to claim 7 wherein when in the free standing state a bottom end of the cylindrical brush does not extend past a bottom end of the support stand.

9. A rotary push broom according to claim 6 wherein the support stand is in the form of a plate having a flat bottom end.

10. A rotary push broom according to claim 6 wherein at least a portion of a bottom end of the support stand lies above a bottom end of the pair of wheels when the frame is titled in a rearward direction.

11. A rotary push broom according to claim 6 wherein the frame includes the at least one support stand in the form of plate connected by a crossbar to another support stand in the form of a plate.

12. A rotary push broom according to claim 6 wherein the at least one support stand is arranged between one of the wheels in the pair of wheels and the cylindrical brush.

13. A rotary push broom according to claim 12 further comprising the at least one support stand being integrated with a plate having two openings, with one opening co-axial to the centerline of the pair of wheels and the other opening co-axial to the centerline of the cylindrical brush.

14. A rotary push broom according to claim 6 wherein the frame includes a crossbar connecting the at least one support stand to the rotary push broom.

15. A rotary push broom according to claim 1 wherein the cylindrical brush rotates in the forward direction at a slower rotational speed than that of the pair of wheels.

16. A rotary push broom comprising:

a pair of wheels arranged in a frame along a same centerline;

a cylindrical brush arranged in the frame along a centerline different than a centerline of the pair of wheels;

a ratchet gearing system arranged to rotate the cylindrical brush when the pair of wheels is rotating in a forward direction and cause the cylindrical brush to rotate independent of the pair of wheels when the pair of wheels is rotating in a rearward direction; and at least one support stand arranged to maintain the rotary push broom in a free-standing state when not in use and to not interfere with the rotary push broom when the rotary push broom is in an operational state.

17. A rotary push broom according to claim 16 wherein the ratchet gearing system is arranged such that a rotational speed of the cylindrical brush is slower than that of the wheels in the forward direction.

18. A rotary push broom according to claim 16 wherein the centerline of the cylindrical brush is arranged such that an angular rotation of the frame of the rotary push broom changes a vertical height of the cylindrical brush relative to the centerline of the wheels.

19. A rotary push broom according to claim 16 further comprising the frame including a crossbar connecting the at least one support stand to the rotary push broom.

20. A rotary push broom according to claim 19 wherein the at least one support stand is integrated with a plate arranged to connect one of the wheels to the frame and accommodate at least a portion of the ratchet gearing system.

21. A rotary push broom comprising:

a pair of wheels arranged in a frame along a same centerline;

a cylindrical brush arranged in the frame along a centerline different than the centerline of the pair of wheels; and a ratchet gearing system arranged to provide a different rotational speed of the cylindrical brush relative to that of the pair of wheels when the pair of wheels is rotating in a forward direction and cause the cylindrical brush to rotate independent of the pair of wheels when the pair of wheels is rotating in a rearward direction;

the ratchet gearing system further including a first gear connected to a wheel in the pair of wheels and a second gear mated to the first gear and connected to a drive shaft of the cylindrical brush, the second gear having at least one cavity which receives the drive shaft, the at least one cavity having a curved surface and an opposing flat surface.

* * * * *